US009310703B2

(12) United States Patent
Matsumoto et al.

(10) Patent No.: US 9,310,703 B2
(45) Date of Patent: Apr. 12, 2016

(54) VIOLET TONER, DEVELOPER, AND TONER SET

(71) Applicant: FUJI XEROX CO., LTD., Tokyo (JP)

(72) Inventors: Akira Matsumoto, Kanagawa (JP); Yukiaki Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/052,090

(22) Filed: Oct. 11, 2013

(65) Prior Publication Data

US 2014/0227639 A1 Aug. 14, 2014

(30) Foreign Application Priority Data

Feb. 14, 2013 (JP) ..... 2013-026746

(51) Int. Cl.
*G03G 9/087* (2006.01)
*G03G 9/09* (2006.01)
*G03G 9/08* (2006.01)

(52) U.S. Cl.
CPC ..... *G03G 9/08755* (2013.01); *G03G 9/0819* (2013.01); *G03G 9/0827* (2013.01); *G03G 9/08782* (2013.01); *G03G 9/08795* (2013.01); *G03G 9/08797* (2013.01); *G03G 9/0914* (2013.01)

(58) Field of Classification Search
CPC ..... G03G 9/0914; G03G 9/08755; G03G 9/08797; G03G 9/08795
USPC ..... 430/107.1, 108.21, 109.4, 45.4, 45.5
See application file for complete search history.

(56) References Cited

U.S. PATENT DOCUMENTS

| | | | | |
|---|---|---|---|---|
| 7,572,564 | B2 * | 8/2009 | Sato et al. | 430/108.4 |
| 2009/0059138 | A1 | 3/2009 | Matsumoto et al. | |
| 2009/0069473 | A1 | 3/2009 | Kusano et al. | |
| 2009/0190073 | A1 | 7/2009 | Yoshino et al. | |
| 2010/0183966 | A1 * | 7/2010 | Kadokura et al. | 430/107.1 |
| 2010/0248123 | A1 * | 9/2010 | Iwanaga et al. | 430/109.4 |
| 2012/0077119 | A1 | 3/2012 | Yoshida et al. | |
| 2012/0183894 | A1 * | 7/2012 | Matsumoto et al. | 430/105 |

FOREIGN PATENT DOCUMENTS

| | | | |
|---|---|---|---|
| JP | A-10-133415 | | 5/1998 |
| JP | 2004-070313 | A * | 3/2004 |
| JP | A-2007-262378 | | 10/2007 |
| JP | A-2008-138194 | | 6/2008 |
| JP | 2012-068581 | A | 4/2012 |
| JP | 2012-150163 | A | 8/2012 |

OTHER PUBLICATIONS

American Chemical Society (ACS) File Registry No. No. 147-14-8 on STN, copyright 2014, which was entered in STN Nov. 16, 1984.*

American Chemical Society (ACS) File Registry No. No. 17741-63-8 on STN, copyright 2014, which was entered in STN Nov. 16, 1984.*

AIPN Japanese Patent Office machine-assisted English-language translation of JP 2004-070313 A (pub. Mar. 2004).*

Jan. 5, 2016 Office Action issued in Japanese Application No. 2013-026746.

* cited by examiner

*Primary Examiner* — Janis L Dote
(74) *Attorney, Agent, or Firm* — Oliff PLC

(57) ABSTRACT

A violet toner includes toner particles that contain a binder resin including an amorphous polyester resin composed of a polycondensate of a polyol and a polyvalent carboxylic acid including a trimellitic acid, and C.I. Pigment Violet 37, wherein a molar ratio of the trimellitic acid is from 0.1 mol % to 10 mol % with respect to the entire polymerization components of the amorphous polyester resin, and a content of C.I. Pigment Violet 37 is from 1% by weight to 20% by weight with respect to the total weight of the toner particles.

15 Claims, 1 Drawing Sheet

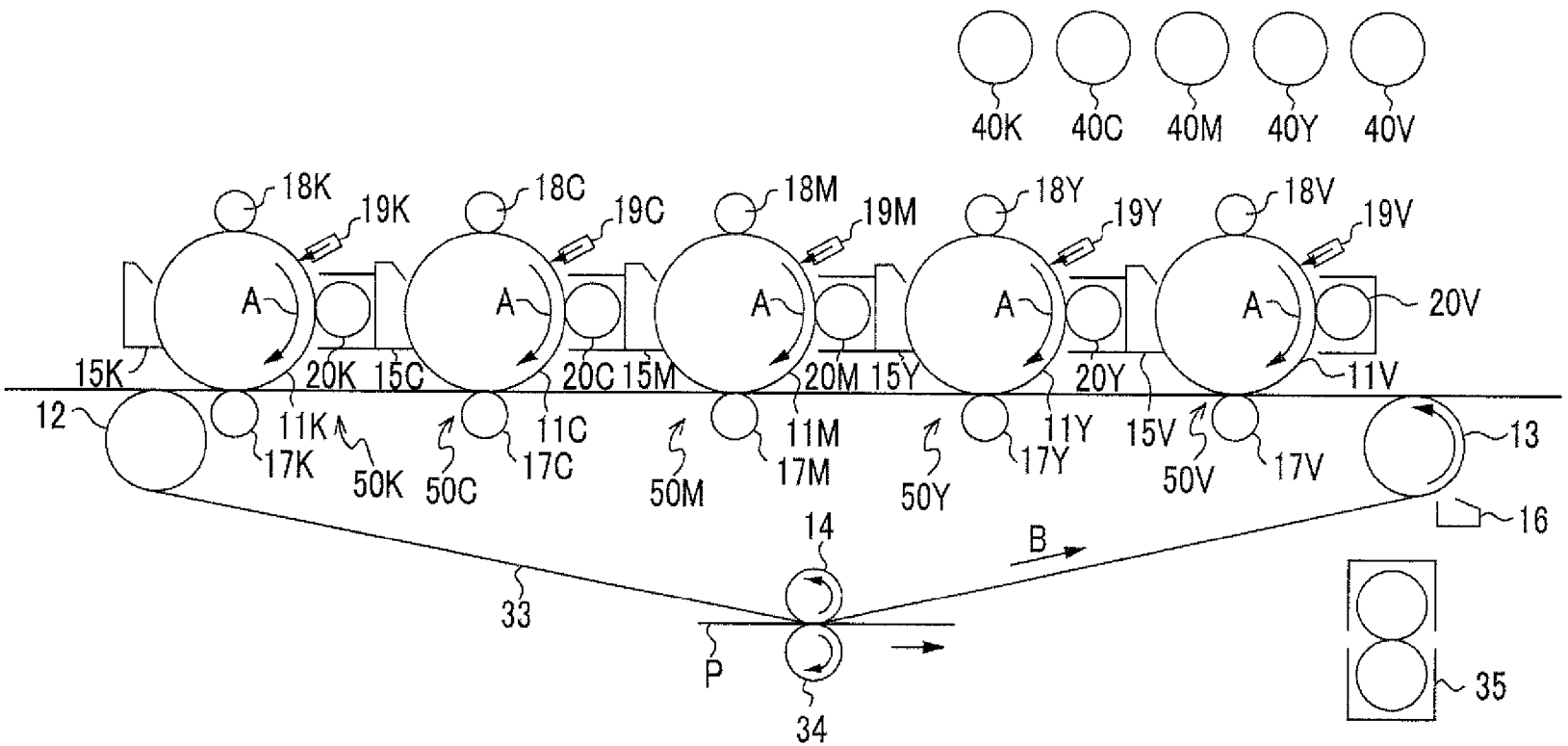
40K
40C
40M
40Y
40V
18K
19K
20K
15K
11K
17K
50K
18C
19C
20C
15C
11C
17C
50C
18M
19M
20M
15M
11M
17M
50M
18Y
19Y
20Y
15Y
11Y
17Y
50Y
18V
19V
20V
11V
17V
50V
15V
A
B
12
13
14
16
33
34
35
P

VIOLET TONER, DEVELOPER, AND TONER SET

CROSS-REFERENCE TO RELATED APPLICATIONS

This application is based on and claims priority under 35 USC 119 from Japanese Patent Application No. 2013-026746 filed Feb. 14, 2013.

BACKGROUND

1. Technical Field

The present invention relates to a violet toner, a developer, and a toner set.

2. Related Art

In recent years, image forming apparatuses, mostly printers and copiers, are widely used, and techniques related to various constituent elements of an image forming apparatus are also widely used. In electrophotographic image forming apparatuses among the image forming apparatuses, a photoreceptor (image holding member) is usually charged by a charging device to form, on the charged photoreceptor, an electrostatic charge image having a different potential from the surrounding potential to thereby form a pattern, and thus an electrostatic charge image formed in this manner is developed with a toner, and then finally transferred onto a recording medium such as recording paper.

SUMMARY

According to an aspect of the invention, there is provided a violet toner including: toner particles that contain a binder resin including an amorphous polyester resin composed of a polycondensate of a polyol and a polyvalent carboxylic acid including a trimellitic acid, and C.I. Pigment Violet 37, wherein a molar ratio of the trimellitic acid is from 0.1 mol % to 10 mol % with respect to the entire polymerization components of the amorphous polyester resin, and a content of C.I. Pigment Violet 37 is from 1% by weight to 20% by weight with respect to the total weight of the toner particles.

BRIEF DESCRIPTION OF THE DRAWINGS

Exemplary embodiments of the present invention will be described in detail based on the following figures, wherein:

FIG. 1 is a schematic diagram showing a configuration of an example of an image forming apparatus according to an exemplary embodiment.

DETAILED DESCRIPTION

Hereinafter, exemplary embodiments of the invention will be described in detail.

Electrostatic Charge Image Developing Violet Toner

An electrostatic charge image developing violet toner according to an exemplary embodiment (hereinafter, may be referred to as "violet toner") has toner particles that contain: an amorphous polyester resin (hereinafter, referred to as "specific amorphous polyester resin") composed of a polycondensate of a polyol and a polyvalent carboxylic acid including a trimellitic acid; and C.I. Pigment Violet 37.

The molar ratio of the trimellitic acid is from 0.1 mol % to 10 mol % with respect to the entire polymerization components of the specific amorphous polyester resin, and the content of C.I. Pigment Violet 37 is from 1% by weight to 20% by weight with respect to the total weight of the toner particles.

Since the violet toner according to this exemplary embodiment has the above configuration, an image having a wide color reproduction area is obtained.

The reason for this is not clear, but it is thought that this is due to the following reason.

First, the compatibility of C.I. Pigment Violet 37 with the amorphous polyester resin is poor, and it is thought that aggregation easily occurs in the amorphous polyester resin due to steric hindrance or the like. This is because the polarity of the amorphous polyester resin is ununiformly derived. Accordingly, C.I. Pigment Violet 37 is ununiformly dispersed in the toner particles, and thus it is thought that the color reproduction area is reduced.

Meanwhile, it is thought that when the specific amorphous polyester resin contains, as a polymerization component, a component derived from the trimellitic acid in the above molar ratio range, the polarity on a molecular level thereof increases, and thus it is thought that the polarity of the entire specific amorphous polyester resin becomes more uniform.

Therefore, when the toner particles contain the above content of C.I. Pigment Violet 37 together with the amorphous polyester resin, it is thought that C.I. Pigment Violet 37 is prevented from being aggregated and is thus uniformly dispersed in the toner particles.

Therefore, an image having a wide color reproduction area may be obtained with the violet toner according to this exemplary embodiment.

In addition, since C.I. Pigment Violet 37 is dispersed more uniformly in the toner particles, it is thought that an image having great color is also obtained with the violet toner according to this exemplary embodiment.

Particularly, C.I. Pigment Violet 37 easily aggregates when the toner particles are prepared by a wet granulation method. However, in the violet toner according to this exemplary embodiment, this problem is remedied, and thus an image having a wide color reproduction area is obtained even when the toner particles are prepared by the wet granulation method.

The violet toner according to this exemplary embodiment contains toner particles, and if necessary, an external additive.

Toner Particles

The toner particles contain, for example, a binder resin, a colorant, and if necessary, a release agent and other additives.

Binder Resin

At least a specific amorphous polyester resin (hereinafter, may be simply referred to as "amorphous polyester resin") is applied as the binder resin.

As the binder resin, a crystalline polyester resin may be used in combination together with the amorphous polyester resin.

The content of the specific amorphous polyester resin may preferably be from 60% by weight or greater (more preferably 80% by weight or greater) with respect to the entire binder resin. The content of the crystalline polyester resin may preferably be from 2% by weight to 40% by weight (more preferably from 2% by weight to 20% by weight) with respect to the entire binder resin.

The "crystalline" resin indicates that the resin does not exhibit a stepwise change in endothermic quantity, but has a definite endothermic peak in differential scanning calorimetry (DSC). Specifically, the "crystalline" resin indicates that the half-value width of the endothermic peak in the measurement at a rate of temperature increase of 10 (° C./min) is within 10° C.

On the other hand, the "amorphous" resin indicates that the half-value width is greater than 10° C., a stepwise change in endothermic quantity is shown, or a definite endothermic peak is not recognized.

Amorphous Polyester Resin

The amorphous polyester resin is a polyester resin configured of a polycondensate of a polyol and a polyvalent carboxylic acid including a trimellitic acid.

Specifically, the polyester resin is a polycondensate of, for example, a polyol, a trimellitic acid, and other polyvalent carboxylic acids other than the trimellitic acid.

The trimellitic acid also contains trimellitic anhydride.

Examples of other polyvalent carboxylic acids include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferable as the polyvalent carboxylic acid.

As other polyvalent carboxylic acids, a tri- or higher-valent carboxylic acid having a crosslinked structure or a branched structure may be used in combination together with a dicarboxylic acid. Examples of the tri- or higher-valent carboxylic acid include pyromellitic acid, anhydrides thereof, or lower alkyl esters (having, for example, from 1 to 5 carbon atoms) thereof.

Other polyvalent carboxylic acids may be used singly or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic dials and alicyclic dials are preferable, and aromatic diols are more preferable as the polyol.

As the polyol, a tri- or higher-valent polyol having a crosslinked structure or a branched structure may be used in combination together with diol. Examples of the tri- or higher-valent polyol include glycerin, trimethylolpropane, and pentaerythritol.

The polyols may be used singly or in combination of two or more kinds thereof.

Here, in the amorphous polyester resin, the molar ratio of the trimellitic acid is from 0.1 mol % to 10 mol %, preferably from 0.5 mol % to 5.0 mol %, and more preferably from 0.8 mol % to 3.0 mol % with respect to the entire polymerization components (entire monomers used: all polyvalent carboxylic acids and polyols used) of the specific polyester resin.

When the molar ratio of the trimellitic acid is 0.1 mol % or greater, an image having a high color reproduction area is obtained.

When the molar ratio of the trimellitic acid is 10 mol % or less, the polarity of the toner particles is prevented from excessively increasing, and as a result, a reduction in charges due to moisture absorption is prevented, and thus a vivid image in which developing unevenness, transfer unevenness, and the like are prevented is easily obtained.

The glass transition temperature (Tg) of the amorphous polyester resin is preferably from 50° C. to 80° C., and more preferably from 50° C. to 65° C.

The glass transition temperature is obtained from a DSC curve obtained by differential scanning caloritometory (DSC). More specifically, the glass transition temperature is obtained from "extrapolated glass transition onset temperature" described in the method of obtaining a glass transition temperature in "testing methods for transition temperatures of plastics" in JIS K-1987.

The weight average molecular weight (Mw) of the amorphous polyester resin is preferably from 5,000 to 1,000,000, and more preferably from 7,000 to 500,000.

The number average molecular weight (Mn) of the amorphous polyester resin is preferably from 2,000 to 100,000.

The molecular weight distribution Mw/Mn of the amorphous polyester resin is preferably from 1.5 to 100, and more preferably from 2 to 60.

The weight average molecular weight and the number average molecular weight are measured by gel permeation chromatography (GPC). The molecular weight measurement by GPC is performed using HLC-8120, which is GPC manufactured by Tosoh Corporation as a measuring device, TSK GEL SUPER HM-M (15 cm) as a column manufactured by Tosoh Corporation, and a THF solvent. The weight average molecular weight and the number average molecular weight are calculated using a molecular weight calibration curve plotted from a monodisperse polystyrene standard sample from the results of the above measurement.

A known manufacturing method is used to manufacture the amorphous polyester resin. Specific examples thereof include a method of conducting a reaction at a polymerization temperature set to from 180° C. to 230° C., if necessary, under reduced pressure in the reaction system, while removing water or an alcohol that is generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in the copolymerization reaction, the monomer having poor compatibility and an acid or an alcohol to be polycondensed with the monomer may be previously condensed and then polycondensed with the main component.

Crystalline Polyester Resin

Examples of the crystalline polyester resin include a polycondensate of a polyvalent carboxylic acid and a polyol. A commercially available product or a synthesized product may be used as the crystalline polyester resin.

Here, as the crystalline polyester resin, a polycondensate using a polymerizable monomer having a linear aliphatic group is preferably used rather than a polymerizable monomer having an aromatic group, in order to easily form a crystal structure.

Examples of the polyvalent carboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids such as phthalic acid, isophthalic acid, terephthalic acid, naphthalene-2,6-dicarboxylic acid, malonic acid, and mesaconic acid), anhydrides thereof, or lower alkyl esters (having, for example, from 1 to 5 carbon atoms) thereof.

As the polyvalent carboxylic acid, a tri- or higher-valent carboxylic acid having a crosslinked structure or a branched structure may be used in combination together with a dicarboxylic acid. Examples of the trivalent carboxylic acid include aromatic carboxylic acids (e.g., 1,2,3-benzenetricarboxylic acid, 1,2,4-benzenetricarboxylic acid, and 1,2,4-naphthalenetricarboxylic acid), anhydrides thereof, or lower alkyl esters (having, for example, from 1 to 5 carbon atoms) thereof.

As the polyvalent carboxylic acid, a dicarboxylic acid having a sulfonic acid group or a dicarboxylic acid having an ethylenic double bond may be used in combination together with these dicarboxylic acids.

The polyvalent carboxylic acids may be used singly or in combination of two or more kinds thereof.

Examples of the polyol include aliphatic dials (e.g., linear aliphatic diols having from 7 to 20 carbon atoms in a main chain part). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, 1,8-octanediol, 1,9-nonanediol, and 1,10-decanediol are preferable as the aliphatic diol.

As the polyol, a tri- or higher-valent polyol having a crosslinked structure or a branched structure may be used in combination together with diol. Examples of the tri- or higher-valent polyol include glycerin, trimethylolethane, trimethylolpropane, and pentaerythritol.

The polyols may be used singly or in combination of two or more kinds thereof.

Here, in the polyol, the content of the aliphatic diol may be 80 mol % or greater, and is preferably 90 mol % or greater.

The melting temperature of the crystalline polyester resin is preferably from 50° C. to 100° C., more preferably from 55° C. to 90° C., and even more preferably from 60° C. to 85° C.

The melting temperature is obtained from "melting peak temperature" described in the method of obtaining a melting temperature in "testing methods for transition temperatures of plastics" in JIS K-1987, from a DSC curve obtained by differential scanning calorimetry (DSC).

The weight average molecular weight (Mw) of the crystalline polyester resin is preferably from 6,000 to 35,000.

For example, a known manufacturing method is used to manufacture the crystalline polyester resin as in the case of the amorphous polyester resin.

Other Binder Resins

As the binder resin, other binder resins may be used in combination, other than the above-described polyester.

Examples of other binder resins include vinyl resins formed of homopolymers of monomers such as styrenes (e.g., styrene, p-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene and butadiene), or copolymers obtained by combining two or more kinds of these monomers.

As the binder resin, there are also exemplified non-vinyl resins such as epoxy resins, polyester resins, polyurethane resins, polyamide resins, cellulose resins, polyether resins, and modified rosin, mixtures thereof with the above-described vinyl resins, or graft polymers obtained by polymerizing a vinyl monomer with the coexistence of such non-vinyl resins.

These other binder resins may be used singly or in combination of two or more kinds thereof.

These other binder resins are blended to the extent that toner characteristics are not affected.

The content of the binder resin may be, for example, from 40% by weight to 95% by weight, and is preferably from 50% by weight to 90% by weight, and more preferably from 60% by weight to 83% by weight with respect to the entire toner particles.

Colorant

As the colorant, C.I. Pigment Violet 37 is applied.

As the colorant, other colorants may be used in combination together with C.I. Pigment Violet 37. Although also depending on a target hue of the toner, the content of other colorants may be 20% by weight or less with respect to the entire colorant. That is, C.I. Pigment Violet 37 is 80% by weight or greater, and preferably 100% by weight with respect to the entire colorant.

Examples of other colorants include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 33, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The other colorants may be used singly or in combination of two or more kinds thereof.

If necessary, the colorant may be surface-treated or used in combination with a dispersant. Plural kinds of colorants may be used in combination.

The content of the colorant is, for example, preferably from 1% by weight to 30% by weight, and more preferably from 3% by weight to 15% by weight with respect to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from "melting peak temperature" described in the method of obtaining a melting temperature in "testing methods for transition temperatures of plastics" in JIS K-1987, from a DSC curve obtained by differential scanning calorimetry (DSC).

Among these release agents, hydrocarbon waxes are preferable. Examples of the hydrocarbon waxes include Fischer Tropsch waxes, polyethylene waxes, polypropylene waxes, paraffin waxes, and microcrystalline waxes.

Specifically, as the release agent, a hydrocarbon wax having a melting temperature of from 60° C. to 100° C. may be preferably applied. Particularly, when a crystalline polyester resin having a low solubility parameter is used as the binder resin, it is thought that compatibility with C.I. Pigment Violet 37 as a colorant is improved when this hydrocarbon wax is used in combination, and aggregation of the colorant is further prevented. At this time, when the melting temperature of the hydrocarbon wax is higher than the melting temperature of the crystalline polyester resin, the crystalline polyester resin is melted first and compatibilized with an amorphous polyester resin at the time of fixing, and the hydrocarbon wax is melted when the solubility parameter is reduced. Accordingly, it is thought that the formation of a domain of the hydrocarbon wax is prevented, and an image having great color is obtained.

The proportion of the crystalline polyester resin in the entire binder resin in an aspect in which the hydrocarbon wax and the crystalline polyester resin are used in combination is preferably from 1% by weight to 10% by weight, and more preferably from 2% by weight to 8% by weight with respect to the entire binder resin. When the content of the crystalline polyester resin is 1% by weight or greater, the amount of reduction in the solubility parameter when the crystalline polyester resin is compatibilized with the amorphous polyester resin increases, and thus the formation of a domain of the release agent is prevented and color development is improved. In addition, when the content of the crystalline polyester resin is 10% by weight or less, the formation of a domain of the crystalline resin itself is prevented and color development is improved.

The content of the release agent is, for example, preferably from 1% by weight to 20% by weight, and more preferably from 5% by weight to 15% by weight with respect to the entire toner particles.

Other Additives

Examples of other additives include known additives such as a magnetic material, a charge-controlling agent, and an inorganic powder. The toner particles include these additives as internal additives.

Characteristics of Toner Particles

The toner particles may have a single-layer structure, or a so-called core-shell structure composed of a core (core particle) and a coating layer (shell layer) that is coated on the core.

Here, toner particles having a core-shell structure may be preferably composed of, for example, a core containing a binder resin, a colorant, and if necessary, other additives such as a release agent, and a coating layer containing a binder resin.

The volume average particle size (D50v) of the toner particles is preferably from 2 μm to 10 μm, and more preferably from 4 μm to 8 μm.

Various average particle sizes and various particle size distribution indices of the toner particles are measured using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of an aqueous solution of 5% surfactant (preferably sodium alkylbenzene sulfonate) as a dispersant. The obtained material is added to from 100 ml to 150 ml of the electrolyte.

The electrolyte in which the sample is suspended is subjected to a dispersion treatment using an ultrasonic disperser for 1 minute, and a particle size distribution of particles having a particle size of from 2 μm to 60 μm is measured by a COULTER MULTISIZER II using an aperture having an aperture size of 100 μm. 50,000 particles are sampled.

Cumulative distributions by volume and by number are drawn from the side of the smallest size with respect to particle size ranges (channels) divided based on the measured particle size distribution. The particle size when the cumulative percentage becomes 16% is defined as that corresponding to a volume average particle size D16v and a number average particle size D16p, while the particle size when the cumulative percentage becomes 50% is defined as that corresponding to a volume average particle size D50v and a number average particle size D50p. Furthermore, the particle size when the cumulative percentage becomes 84% is defined as that corresponding to a volume average particle size D84v and a number average particle size D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

A shape factor SF1 of the toner particles is preferably from 110 to 150, and more preferably from 120 to 140.

The shape factor SF1 is obtained using the following expression.

$$\text{Expression: } SF1=(ML^2/A)\times(\pi/4)\times 100$$

In the above expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and calculated as follows. That is, an optical microscopic image of particles applied to a surface of a glass slide is input to an image analyzer LUZEX through a video camera to obtain maximum lengths and projected areas of 100 particles, values of SF1 are calculated using the above expression, and an average value thereof is obtained.

External Additive

For example, inorganic particles are exemplified as an external additive. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

Surfaces of the inorganic particles as an external additive may be subjected to a hydrophobizing treatment. The hydrophobizing treatment is performed by, for example, dipping the inorganic particles in a hydrophobizing agent. The hydrophobizing agent is not particularly limited, and examples thereof include silane coupling agents, silicone oils, titanate coupling agents, and aluminum coupling agents. These may be used singly or in combination of two or more kinds thereof.

The amount of the hydrophobizing agent is generally, for example, from 1 part by weight to 10 parts by weight with respect to 100 parts by weight of the inorganic particles.

As other external additives, there are also exemplified resin particles (resin particles such as polystyrene particles, PMMA particles, and melamine resin particles) and a cleaning activator (e.g., particles of metal salt of higher fatty acid represented by zinc stearate and particles of fluorine high-molecular weight polymer).

The amount of the external additive to be externally added is, for example, preferably from 0.01% by weight to 5% by weight, and more preferably from 0.01% by weight to 2.0% by weight with respect to the toner particles.

Toner Manufacturing Method

Next, a method of manufacturing a toner according to this exemplary embodiment will be described.

The toner according to this exemplary embodiment is obtained by externally adding an external additive to toner particles after manufacturing of the toner particles.

The toner particles may be manufactured using any one of a dry manufacturing method (e.g., kneading and pulverization method) and a wet manufacturing method (e.g., aggregation and coalescence method, suspension and polymerization method, and dissolution and suspension method). The toner particle manufacturing method is not particularly limited to these manufacturing methods, and a known manufacturing method is employed.

Among these, a wet manufacturing method (e.g., aggregation and coalescence method, suspension and polymerization method, and dissolution and suspension method), particularly, an aggregation and coalescence method is preferably used to obtain toner particles.

Specifically, for example, when the toner particles are manufactured by an aggregation and coalescence method, the toner particles are manufactured through the steps of: preparing a resin particle dispersion in which resin particles as a binder resin are dispersed and a colorant particle dispersion in which colorant particles are dispersed (dispersion preparation step); aggregating the resin particles and the colorant particles (if necessary, other particles) in the resin particle dispersion (if necessary, in the dispersion after mixing with other particle dispersions) to form aggregated particles (aggregated particle forming step); and heating the aggregated particle dispersion in which the aggregated particles are dispersed, to coalesce the aggregated particles, thereby forming toner particles (coalescence step).

Hereinafter, the respective steps will be described in detail.

In the following description, a method of obtaining toner particles containing a colorant and a release agent will be described. However, the release agent is used if necessary. Other additives other than the release agent may be used.

Dispersion Preparation Step

First, for example, a colorant particle dispersion in which colorant particles are dispersed and a release agent particle dispersion in which release agent particles are dispersed are prepared together with a resin particle dispersion in which resin particles as a binder resin are dispersed.

Here, the resin particle dispersion is prepared by, for example, dispersing resin particles by a surfactant in a dispersion medium.

Examples of the dispersion medium that is used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as sulfate, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol nonionic surfactants. Among these, anionic surfactants and cationic surfactants are particularly preferable. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer or a ball mill, a sand mill, or a Dyne mill having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); converting the resin (so-called phase inversion) from W/O to O/W by adding an aqueous medium (W phase) to form a discontinuous phase, thereby dispersing the resin as particles in the aqueous medium.

The volume average particle size of the resin particles that are dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle size of the resin particles, a cumulative distribution by volume is drawn from the side of the smallest size with respect to particle size ranges (channels) divided using the particle size distribution obtained by the measurement of a laser diffraction-type particle size distribution measuring device (for example, manufactured by Horiba, Ltd. LA-700), and a particle size when the cumulative percentage becomes 50% with respect to the entire particles is measured as a volume average particle size D50v. The volume average particle size of the particles in other dispersions is also measured in the same manner.

The content of the resin particles that are contained in the resin particle dispersion is, for example, preferably from 5% by weight to 50% by weight, and more preferably from 10% by weight to 40% by weight.

For example, the colorant particle dispersion and the release agent particle dispersion are prepared in the same manner as in the case of the resin particle dispersion. That is, the particles in the resin particle dispersion are the same as the colorant particles that are dispersed in the colorant particle dispersion and the release agent particles that are dispersed in the release agent particle dispersion, in terms of the volume average particle size, the dispersion medium, the dispersing method, and the content of the particles.

Aggregated Particle Forming Step

Next, the colorant particle dispersion and the release agent particle dispersion are mixed together with the resin particle dispersion.

The resin particles, the colorant particles, and the release agent particles are heterogeneously aggregated in the mixed dispersion to form aggregated particles with a size near a target toner particle size that include the resin particles, the colorant particles, and the release agent particles.

Specifically, for example, an aggregating agent is added to the mixed dispersion and a pH of the mixed dispersion is adjusted to acidic (for example, the pH is from 2 to 5). If necessary, a dispersion stabilizer is added. Then, the mixed dispersion is heated to a glass transition temperature of the resin particles (specifically, for example, from glass transition temperature of the resin particles −30° C. to glass transition temperature −10° C.) to aggregate the particles dispersed in the mixed dispersion, thereby forming the aggregated particles.

In the aggregated particle forming step, for example, the aggregating agent may be added at room temperature (for example, 25° C.) under stirring of the mixed dispersion using a rotary shearing-type homogenizer, the pH of the mixed dispersion may be adjusted to acidic (for example, the pH is from 2 to 5), a dispersion stabilizer may be added if necessary, and the heating may be then performed.

Examples of the aggregating agent include a surfactant having an opposite polarity of the polarity of the surfactant that is used as the dispersant to be added to the mixed dispersion, such as inorganic metal salts and di- or higher-valent metal complexes. Particularly, when a metal complex is used as the aggregating agent, the amount of the surfactant to be used is reduced and charging characteristics are improved.

If necessary, an additive may be used that forms a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent to be added is, for example, preferably from 0.01 part by weight to 5.0 parts by weight, and more preferably from 0.1 part by weight to less than 3.0 parts by weight with respect to 100 parts by weight of the resin particles.

Coalescence Step

Next, the aggregated particle dispersion in which the aggregated particles are dispersed is heated to, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the above steps.

Toner particles may be manufactured through the steps of: further mixing, after obtaining the aggregated particle dispersion in which the aggregated particles are dispersed, the resin particle dispersion in which the resin particles are dispersed with the aggregated particle dispersion to conduct aggregation so that the resin particles are further attached to the surfaces of the aggregated particles, thereby forming second aggregated particles; and coalescing the second aggregated particles by heating a second aggregated particle dispersion in which the second aggregated particles are dispersed, thereby forming toner particles having a core-shell structure.

Here, after the coalescence step ends, the toner particles formed in the solution are subjected to a washing step, a solid-liquid separation step, and a drying step, that are well known, and thus dry toner particles are obtained.

In the washing step, preferably, displacement washing with ion exchange water may be sufficiently performed from the viewpoint of charging properties. In addition, the solid-liquid separation step is not particularly limited, but suction filtration, pressure filtration, or the like may be preferably performed from the viewpoint of productivity. Furthermore, the method for the drying step is also not particularly limited, but freeze drying, flash jet drying, fluidized drying, vibration-type fluidized drying, or the like may be preferably performed from the viewpoint of productivity.

The violet toner according to this exemplary embodiment is manufactured by, for example, adding an external additive to dry toner particles that have been obtained, and mixing them. The mixing may be performed with, for example, a V-blender, a HENSCHEL mixer, a Lödige mixer, or the like. Furthermore, if necessary, coarse toner particles may be removed using a vibrating sieving machine, a wind classifier, or the like.

Toner Set

A toner set according to this exemplary embodiment has at least one selected from the violet toner according to this exemplary embodiment, a yellow toner, a magenta toner, and a cyan toner.

Known toners are exemplified as color toners, i.e., the yellow toner, the magenta toner, and the cyan toner. These color toners preferably has the same material composition, excluding the colorant, as the violet toner according to this exemplary embodiment from the viewpoint of charging properties and fixability.

Particularly, the magenta toner may preferably include at least one selected from C.I. Pigment Red 238 and C.I. Pigment Red 269, as a colorant. When a mixed color image is formed using a toner set of the magenta toner and the violet toner according to this exemplary embodiment, an image having wide color reproducibility from a magenta area to a violet area is easily obtained.

The content of these colorant may be 80% by weight or greater, and is preferably 100% by weight with respect to the toner particles.

In addition, the cyan toner may preferably include C.I. Pigment Blue 15 as a colorant. When a mixed color image is formed using a toner set of the cyan toner and the violet toner according to this exemplary embodiment, an image having wide color reproducibility from a cyan area to a violet area is easily obtained.

The content of these colorants may be 80% by weight or greater, and is preferably 100% by weight with respect to the toner particles.

When a color set having such a combination is used, image quality may be further easily increased to photographic image quality.

Electrostatic Charge Image Developer

An electrostatic charge image developer according to this exemplary embodiment includes at least the violet toner according to this exemplary embodiment.

The electrostatic charge image developer according to this exemplary embodiment may be a single-component developer including only the violet toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; a resin impregnation-type carrier in which a porous magnetic powder is impregnated with a resin; and a resin dispersion-type carrier in which conductive particles are dispersed and blended in a matrix resin.

The magnetic powder dispersion-type carrier, the resin impregnation-type carrier, and the conductive particle dispersion-type carrier may be carriers in which constituent particles of the carrier are cores and coated with a coating resin.

Examples of the magnetic powder include magnetic metals such as iron oxide, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin including an organosiloxane bond or a modified product thereof, a fluororesin, polyester, polycarbonate, a phenol resin, and an epoxy resin.

The coating resin and the matrix resin may contain other additives such as a conductive material.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (mass ratio) between the toner and the carrier in the two-component developer is preferably from 1:100 to 30:100 (toner:carrier), and more preferably from 3:100 to 20:100.

Image Forming Apparatus and Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including: a charging step of charging a surface of an image holding member; an electrostatic charge image forming step of forming an electrostatic charge image on a charged surface of the image holding member; a developing step of developing the electrostatic charge image formed on the surface of the image holding member with the electrostatic charge image developer according to this exemplary embodiment to form a toner image; a transfer step of transferring the toner image formed on the surface of the image holding member onto a surface of a recording medium; and a fixing step of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans, after transfer of a toner image, a surface of an image holding member before charging; or an apparatus that is provided with an erasing unit that irradiates, after transfer of a toner image, a surface of an image holding member with erasing light before charging to remove charges.

In the case of an intermediate transfer-type apparatus, a transfer unit is configured to have, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

Hereinafter, an example of the image forming apparatus according to this exemplary embodiment will be shown. However, this image forming apparatus is not limited thereto. Major parts shown in the drawing will be described, but descriptions of other parts will be omitted.

Hereinafter, the image forming apparatus according to this exemplary embodiment will be described with reference to the drawing.

FIG. 1 is a schematic diagram showing a configuration of an example of the image forming apparatus according to an exemplary embodiment.

The image forming apparatus shown in FIG. 1 relates to a tandem-type configuration in which plural photoreceptors as image holding members are provided, that is, plural image forming units (an example of the image forming unit) are provided. That is, in the image forming apparatus shown in FIG. 1, five image forming units 50V, 50Y, 50M, 50C, and 50K that form a violet image, a yellow image, a magenta image, a cyan image, and a black image, respectively, are arranged in parallel (in tandem) at intervals.

Here, the respective image forming units 50V, 50Y, 50M, 50C, and 50K have the same configuration, except for the color of the toner in the developer that is contained. Accordingly, the image forming unit 50V that forms a violet image will be representatively described.

The same parts as in the image forming unit 50V will be denoted by the reference numerals with yellow (Y), magenta (M), cyan (C), and black (K) added instead of violet (V), and descriptions of the image forming units 50Y, 50M, 50C, and 50K will be omitted.

The violet image forming unit 50V is provided with a photoreceptor 11V as an image holding member. The photoreceptor 11V is driven to be rotated at a preset process speed by a driving unit (not shown) in a direction of the arrow A in the drawing. For example, an organic photoreceptor that is sensitive to an infrared region is used as the photoreceptor 11V.

A charging roll (an example of the charging unit) 18V is provided above the photoreceptor 11V. A preset voltage is applied to the charging roll 18V by a power source (not shown), and a surface of the photoreceptor 11V is charged to a preset potential.

Around the photoreceptor 11V, an exposure device (an example of the electrostatic charge image forming unit) 19V that exposes the surface of the photoreceptor 11V to form an electrostatic charge image is disposed on the downstream side of the charging roll 18V in a rotation direction of the photoreceptor 11V. Here, a LED array that may be miniaturized is used as the exposure device 19V due to the space, but the exposure device 19V is not limited thereto, and there are no problems even when other electrostatic charge image forming units using laser beam or the like are used.

In addition, around the photoreceptor 11V, a developing device (an example of the developing unit) 20V that is provided with a developer holding member holding a violet developer is disposed on the downstream side of the exposure device 19V in the rotation direction of the photoreceptor 11V, and is configured to develop an electrostatic charge image formed on the surface of the photoreceptor 11V with a violet toner, thereby forming a toner image on the surface of the photoreceptor 11V.

An intermediate transfer belt (intermediate transfer member) 33 that primarily transfers the toner image formed on the surface of the photoreceptor 11V is disposed below the photoreceptor 11V so as to extend below five photoreceptors 11V, 11Y, 11M, 11C, and 11K. This intermediate transfer belt 33 is pressed against the surface of the photoreceptor 11V by the primary transfer roll 17V. In addition, the intermediate transfer belt 33 is stretched by three rolls, i.e., a driving roll 12, a support roll 13, and a bias roll 14, and is circumferentially moved in a direction of the arrow B at a moving speed that is the same as the process speed of the photoreceptor 11V. As described above, a violet toner image is primarily transferred onto the surface of the intermediate transfer belt 33, and a yellow toner image, a magenta toner image, a cyan toner image, and a black toner image are primarily transferred in order and laminated.

In addition, around the photoreceptor 11V, a cleaning device 15V for removing a toner remaining on the surface of the photoreceptor 11V and a retransferred toner is disposed on the downstream side of the primary transfer roll 17V in the rotation direction of the photoreceptor 11V (in the direction of the arrow A). A cleaning blade of the cleaning device 15V is attached so as to be brought into pressure contact with the surface of the photoreceptor 11V in a counter direction.

A secondary transfer roll (an example of the secondary transfer unit) 34 is brought into pressure contact with the bias roll 14 that stretches the intermediate transfer belt 33, via the intermediate transfer belt 33. The toner images primarily transferred and laminated on the surface of the intermediate transfer belt 33 are electrostatically transferred onto a surface of recording paper (an example of the recording medium) P that is supplied from a paper cassette (not shown) in the part in which the bias roll 14 and the secondary transfer roll 34 are brought into pressure contact with each other. At this time, in the toner images which are transferred and laminated on the intermediate transfer belt 33, a transparent toner image is positioned on the downmost side (positioned to be brought into contact with the intermediate transfer belt 33).

In addition, a fuser (of the fixing unit) 35 for fixing the toner images multiply-transferred onto the recording paper P to the surface of the recording paper P by heat and a pressure to form a permanent image is disposed downstream of the secondary transfer roll 34.

Examples of the fuser 35 include a fixing belt having a belt shape, the surface of which is made using a low-surface-energy material represented by a fluororesin component or a silicone resin, and a cylindrical fixing roll, the surface of which is made using a low-surface-energy material represented by a fluororesin component or a silicone resin.

Next, operations of the image forming units 50V, 50Y, 50M, 50C, and 50K that form a violet image, a yellow image, a magenta image, a cyan image, and a black image, respectively, will be described. Since the operations of the image forming units 50V, 50Y, 50M, 50C, and 50K are the same, the operations of the violet image forming unit 50V will be representatively described.

In the violet image forming unit 50V, the photoreceptor 11V is rotated at a preset process speed in the direction of the arrow A. The charging roll 18V negatively charges the surface of the photoreceptor 11V to a preset potential. Thereafter, the exposure device 19V exposes the surface of the photoreceptor 11V, and thus an electrostatic charge image according to image information is formed. Next, the developing device 20V reversely develops the negatively charged toner to visualize, on the surface of the photoreceptor 11V, the electrostatic charge image formed on the surface of the photoreceptor 11V, and thus a toner image is formed. Thereafter, the toner image on the surface of the photoreceptor 11V is primarily transferred onto the surface of the intermediate transfer belt 33 by the primary transfer roll 17V. After primary transfer, transfer residues such as a toner remaining on the surface of the photoreceptor 11V are scraped off and removed by the cleaning blade of the cleaning device 15V to provide the photoreceptor 11V for the next image forming step.

The image forming units 50V, 50Y, 50M, 50C, and 50K perform the above operations, and the toner images visualized on the surfaces of the photoreceptors 11V, 11Y, 11M, 11C, and 11K are multiply-transferred onto the surface of the intermediate transfer belt 33 in order. In a color mode, the color toner images are multiply-transferred in order of violet, yellow, magenta, cyan, and black. In a two- or three-color mode, only toner images each having a necessary color are singly- or multiply-transferred in this order. Thereafter, the toner images singly- or multiply-transferred onto the surface of the intermediate transfer belt 33 are secondarily transferred onto the surface of recording paper P transported from the paper cassette (not shown) by the secondary transfer roll 34. Next, the secondarily transferred images are fixed by heating and pressing in the fuser 35. The toner remaining on the surface of the intermediate transfer belt 33 after secondary transfer is removed by a belt cleaner 16 composed of a cleaning blade for the intermediate transfer belt 33.

The violet image forming unit 50V is configured as a process cartridge that is detachable from the image forming apparatus, in which the developing device 20V including the developer holding member that holds a violet electrostatic charge image developer, the photoreceptor 11V, the charging roll 18V, and the cleaning device 15V are formed integrally with each other. In addition, the image forming units 50Y, 50M, 50C, and 50K are also configured as a process cartridge as in the case of the image forming unit 50V.

In addition, the toner cartridges 40V, 40Y, 40M, 40C, and 40K are cartridges that accommodate the respective color toners and are detachable from the image forming apparatus. These are connected to the developing devices corresponding to the respective colors via toner supply tubes (not shown), respectively. In addition, when the toner accommodated in each toner cartridge runs low, the toner cartridge is replaced.

Next, a toner cartridge according to this exemplary embodiment will be described.

The toner cartridge according to this exemplary embodiment accommodates the violet toner according to this exemplary embodiment, and is detachable from the image forming apparatus. The toner cartridge accommodates a violet toner for replenishment for being supplied to the developing unit provided in the image forming apparatus.

The image forming apparatus shown in FIG. 1 has a configuration from which toner cartridges are detachable, and developing devices are connected to the toner cartridges corresponding to the respective developing devices (colors) via toner supply tubes (not shown), respectively. In addition, when the toner accommodated in the toner cartridge runs low, the toner cartridge is replaced.

EXAMPLES

Hereinafter, this exemplary embodiment will be described in detail using examples. However, this exemplary embodiment is not limited to any of these examples. In the following description, "parts" and "%" are based on the weight unless otherwise noted.

Amorphous Polyester Resin and Resin Particle Dispersion Thereof

Synthesis of Amorphous Polyester Resin A1

| | |
|---|---|
| Ethylene Oxide 2.2 Mol Adduct of Bisphenol A: | 40 parts by mol |
| Propylene Oxide 2.2 Mol Adduct of Bisphenol A: | 60 parts by mol |
| Terephthalic Acid: | 42.9 parts by mol |
| Fumaric Acid: | 40 parts by mol |
| Dodecenyl Succinic Anhydride: | 15 parts by mol |
| Trimellitic Anhydride: | 2.1 parts by mol |

The above monomer components, excluding the fumaric acid and the trimellitic anhydride, and 0.25 parts by weight of tin dioctanoate with respect to total 100 parts by weight of the above monomer components are put into a reaction container provided with a stirrer, a thermometer, a condenser, and a nitrogen gas introduction tube. The components are reacted for 6 hours at 235° C. under a flow of nitrogen gas, and then the temperature is reduced to 200° C., and the fumaric acid and the trimellitic anhydride are put into the mixture and reacted for 1 hour. The temperature is increased to 220° C. over 4 hours, and the mixture is polymerized under a pressure of 10 kPa until a target molecular weight is obtained. Thus, a transparent light yellow amorphous polyester resin A1 is obtained.

Preparation of Amorphous Polyester Resin Particle Dispersion A1

A mixed solvent of 160 parts by weight of ethyl acetate and 100 parts by weight of isopropyl alcohol is put into a jacketed 3 L reactor (manufactured by Tokyo Rikakikai Co., Ltd.: BJ-30N) provided with a condenser, a thermometer, a water dripping device, and an anchor blade while the reactor is kept at 40° C. by a water circulating thermostat. 300 parts by weight of the polyester resin A1 is put thereinto, and the mixture is dissolved by stirring at 150 rpm using a three-one motor, thereby obtaining an oil phase. To this stirred oil phase, 14 parts by weight of a 10% ammonia aqueous solution is added dropwise for a dropwise addition time of 5 minutes, and after mixing for 10 minutes, 900 parts by weight of ion exchange water is further added dropwise at a rate of 7 parts by weight per minutes to cause phase inversion, thereby obtaining an emulsion liquid.

Immediately thereafter, 800 parts by weight of the obtained emulsion liquid and 700 parts by weight of ion exchange water are put into a 2 L eggplant flask, which is then set in an evaporator (manufactured by Tokyo Rikakikai Co., Ltd.) provided with a vacuum control unit via a trap ball. The eggplant flask is heated with a hot water bath at 60° C. while being rotated, and is depressurized to 7 kPa while paying attention such that bumping does not occur, thereby removing the solvent. At the time when the solvent collection amount reaches 1,100 parts by weight, the pressure is returned to atmospheric pressure, and the eggplant flask is cooled with water to obtain a dispersion. The obtained dispersion has no solvent odor. A volume average particle size D50 of the resin particles in this dispersion is 130 nm. Thereafter, ion exchange water is added to adjust the solid content concentration to 20%, and this is set as an amorphous polyester resin dispersion A1.

Synthesis of Amorphous Polyester Resin A2 and Preparation of Amorphous Polyester Resin Particle Dispersion A2

An amorphous polyester resin A2 is synthesized in the same manner as in the synthesis of the amorphous polyester resin A1, except that the amount of the terephthalic acid is changed to 44.8 parts by mol and the amount of the trimellitic anhydride is changed to 0.2 part by mol from the amounts used in the synthesis of the amorphous polyester resin A1, and an amorphous polyester resin particle dispersion A2 is prepared in the same manner as in the preparation of the amorphous polyester resin particle dispersion A1.

Synthesis of Amorphous Polyester Resin A3 and Preparation of Amorphous Polyester Resin Particle Dispersion A3

An amorphous polyester resin A3 is synthesized in the same manner as in the synthesis of the amorphous polyester resin A1, except that the amount of the terephthalic acid is changed to 34.6 parts by mol, the amount of the fumaric acid is changed to 31 parts by mol, and the amount of the trimellitic anhydride is changed to 19.4 parts by mol from the amounts used in the synthesis of the amorphous polyester resin A1, and an amorphous polyester resin particle dispersion A3 is prepared in the same manner as in the preparation of the amorphous polyester resin particle dispersion A1.

Synthesis of Amorphous Polyester Resin B1 and Preparation of Amorphous Polyester Resin Particle Dispersion B1

An amorphous polyester resin B1 is synthesized in the same manner as in the synthesis of the amorphous polyester resin A1, except that the amount of the terephthalic acid is changed to 45.0 parts by mol and the amount of the trimellitic anhydride is changed to 0 part by mol (no trimellitic anhydride is blended) from the amounts used in the synthesis of the amorphous polyester resin A1, and an amorphous polyester resin particle dispersion B1 is prepared in the same manner as in the preparation of the amorphous polyester resin particle dispersion A1.

Synthesis of Amorphous Polyester Resin B2 and Preparation of Amorphous Polyester Resin Particle Dispersion B2

An amorphous polyester resin B2 is synthesized in the same manner as in the synthesis of the amorphous polyester resin A1, except that the amount of the terephthalic acid is changed to 44.84 parts by mol and the amount of the trimellitic anhydride is changed to 0.16 part by mol from the amounts used in the synthesis of the amorphous polyester resin A1, and an amorphous polyester resin particle dispersion B2 is prepared in the same manner as in the preparation of the amorphous polyester resin particle dispersion A1.

Synthesis of Amorphous Polyester Resin B3 and Preparation of Amorphous Polyester Resin Particle Dispersion B3

An amorphous polyester resin B3 is synthesized in the same manner as in the synthesis of the amorphous polyester resin A1, except that the amount of the terephthalic acid is changed to 34.6 parts by mol, the amount of the fumaric acid is changed to 30 parts by mol, and the amount of the trimellitic anhydride is changed to 20.4 parts by mol from the amounts used in the synthesis of the amorphous polyester resin A1, and an amorphous polyester resin particle dispersion B3 is prepared in the same manner as in the preparation of the amorphous polyester resin particle dispersion A1.

Crystalline Polyester Resin and Crystalline Polyester Resin Particle Dispersion

Synthesis of Crystalline Polyester Resin C1

| | |
|---|---|
| 1,10-Dodecanedioic Acid: | 50 mol % |
| 1,9-Nonanediol: | 50 mol % |

The monomer components are put into a reaction container provided with a stirrer, a thermometer, a condenser, and a nitrogen gas introduction tube, and the atmosphere in the reaction container is substituted with dry nitrogen gas. Then, 0.25 parts of titanium tetrabutoxide (reagent) is put with respect to 100 parts of the monomer components. The mixture is reacted under stirring for 3 hours at 170° C. under a nitrogen gas flow, and then the temperature is increased to 210° C. over 1 hour and the inside of the reaction container is depressurized to 3 kPa to conduct the reaction under stirring for 13 hours under reduced pressure, thereby obtaining a crystalline polyester resin C1.

The obtained crystalline polyester resin C1 has a melting temperature (by DSC) of 73.6° C., a weight average molecular weight Mw (by GPC) of 25,000, a number average molecular weight Mn (by GPC) of 10,500 and an acid value AV of 10.1 mgKOH/g.

Preparation of Crystalline Polyester Resin Particle Dispersion C1

300 parts of the crystalline polyester resin, 160 parts of methyl ethyl ketone (solvent), and 100 parts of isopropyl alcohol (solvent) are put into a jacketed 3 L reactor (manufactured by Tokyo Rikakikai Co., Ltd.: BJ-30N) provided with a condenser, a thermometer, a water dripping device, and an anchor blade, and the resin is mixed by stirring at 100 rpm and dissolved while the mixture is kept at 70° C. by a water circulating thermostat (solution preparation step).

Thereafter, the stirring rotation speed is changed to 150 rpm, the water circulating thermostat is set to 66° C., 17 parts of a 10% ammonia water (reagent) is put over 10 minutes, and then ion exchange water kept warm at 66° C. is added dropwise in an amount of 900 parts in total at a rate of 7 parts per minute to cause phase inversion, thereby obtaining an emulsion liquid.

Immediately thereafter, 800 parts of the obtained emulsion liquid and 700 parts of ion exchange water are put into a 2 L eggplant flask, which is then set in an evaporator (manufactured by Tokyo Rikakikai Co., Ltd.) provided with a vacuum control unit via a trap ball. The eggplant flask is heated with a hot water bath at 60° C. while being rotated, and is depressurized to 7 kPa while paying attention such that bumping does not occur, thereby removing the solvent. At the time when the solvent collection amount reaches 1,100 parts, the pressure is returned to atmospheric pressure, and the eggplant flask is cooled with water to obtain a dispersion. The obtained dispersion has no solvent odor. A volume average particle size D50v of the resin particles in this dispersion is 130 nm. Thereafter, ion exchange water is added to adjust the solid content concentration to 20%, and this is set as a crystalline polyester resin particle dispersion C1.

Colorant Particle Dispersion

Preparation of Violet Colorant Particle Dispersion V1

C.I. Pigment Violet 37 "CHROMOPHTAL VIOLET D5700 (manufactured by BASF)": 200 parts

| | |
|---|---|
| C.I. Pigment Violet 37 "Cromophtal Violet D5700 (manufactured by BASF)": | 200 parts |

-continued

| | |
|---|---|
| Anionic Surfactant (manufactured by Dai-Ichi Kogyo Seiyaku Co., Ltd., Neogen SC): | 33 parts (active ingredient 60%, 10% with respect to the colorant) |
| Ion Exchange Water: | 750 parts |

280 parts of ion exchange water and 33 parts of the anionic surfactant are put into a stainless-steel container having such a size that a height of the liquid level is about ⅓ of a height of the container when all of the above components are put, and the surfactant is sufficiently dissolved. Then, the entire solid solution pigment is put and stirred using a stirrer until a non-wetted pigment disappears, and simultaneously, the mixture is sufficiently degassed. After degassing, the remaining ion exchange water is added, and the mixture is dispersed at 5,000 revolutions per minute for 10 minutes using a homogenizer (manufactured by IKA-Werke GmbH & Co. KG., ULTRA TURRAX 150) and then degassed by stirring for one whole day using a stirrer. After degassing, the obtained material is dispersed again at 6,000 revolutions per minute for 10 minutes using the homogenizer and then degassed by stirring for one whole day using the stirrer. Subsequently, the dispersion is dispersed at a pressure of 240 MPa using a high-pressure impact disperser ULTIMIZER (manufactured by Sugino Machine, Ltd., HJP30006). The dispersion is performed to an extent equivalent to 25 passes as converted from the total feed amount and the processing capability of the device. The obtained dispersion is kept for 72 hours to remove precipitates, and ion exchange water is added thereto to adjust the solid content concentration to 15%. The volume average particle size D50 of the particles in this violet colorant particle dispersion V1 is 80 nm. As for the volume average particle size D50, an average value of measured values of three times of measurement, excluding a maximum value and a minimum value, out of five times of measurement by Microtrac is used.

Preparation of Magenta Colorant Particle Dispersion M1

A magenta colorant particle dispersion M1 is prepared in the same manner, except that the colorant is changed to C.I. Pigment Red 269 "SYMULER FAST RED 1022" (manufactured by DIC Corporation) from the colorant used in the preparation of the violet colorant particle dispersion V1.

The volume average particle size D50 of the particles in this magenta colorant particle dispersion M1 is 200 nm.

Preparation of Cyan Colorant Particle Dispersion C1

A cyan colorant particle dispersion C1 is prepared in the same manner, except that the colorant is changed to C.I. Pigment Blue 15 "HELIOGEN BLUE D7092" (manufactured by BASF) from the colorant used in the preparation of the violet colorant particle dispersion V1.

The volume average particle size D50 of the particles in this cyan colorant particle dispersion C1 is 170 nm.

Release Agent Particle Dispersion

Preparation of Release Agent Particle Dispersion 1

| | |
|---|---|
| Hydrocarbon wax (manufactured by Nippon Seiro Co., Ltd., trade name: FNP0080, melting temperature: 80° C.): | 270 parts |
| Anionic Surfactant (manufactured by Dai-Ichi Kogyo Seiyaku Co., Ltd., Neogen RK, active ingredient: 60%): | 13.5 parts (3.0% as the active ingredient with respect to the release agent) |
| Ion Exchange Water: | 21.6 parts |

The above components are mixed, and the release agent is dissolved using a pressure discharge-type homogenizer (manufactured by Manton Gaulin, Inc., GAULIN HOMOGENIZER) at an internal liquid temperature of 120° C. Thereafter, the mixture is subjected to a dispersion treatment for 120 minutes at a dispersion pressure of 5 MPa, and subsequently for 360 minutes at 40 MPa, followed by cooling to obtain a release agent particle dispersion 1. The volume average particle size D50 of the particles in this release agent particle dispersion is 225 nm. Then, ion exchange water is added thereto to adjust the solid content concentration to 20.0%.

Preparation of Release Agent Particle Dispersion 2

A release agent particle dispersion 2 is obtained in the same manner as in the preparation of the release agent particle dispersion 1, except for a change to hydrocarbon wax (manufactured by Nippon Seiro Co., Ltd., trade name: HNP5, melting temperature: 62° C.). The volume average particle size D50 of the particles in this release agent particle dispersion is 230 nm.

Preparation of Release Agent Particle Dispersion 3

A release agent particle dispersion 3 is obtained in the same manner as in the preparation of the release agent particle dispersion 1, except for a change to hydrocarbon wax (manufactured by Toyo Petrolite Co., Ltd., trade name: POLYWAX 655, melting temperature: 98° C.). The volume average particle size D50 of the particles in this release agent particle dispersion is 230 nm.

Preparation of Release Agent Particle Dispersion 4

A release agent particle dispersion 4 is obtained in the same manner as in the preparation of the release agent particle dispersion 1, except for a change to hydrocarbon wax (manufactured by Kao Corporation, trade name: EXCEL P405, melting temperature: 58° C.). The volume average particle size D50 of the particles in this release agent particle dispersion is 210 nm.

Preparation of Release Agent Particle Dispersion 5

A release agent particle dispersion 5 is obtained in the same manner as in the preparation of the release agent particle dispersion 1, except for a change to hydrocarbon wax (manufactured by Toyo Petrolite Co., Ltd., trade name: POLYWAX 725, melting temperature: 102° C.). The volume average particle size D50 of the particles in this release agent particle dispersion is 220 nm.

Aluminum Sulfate Aqueous Solution

| | |
|---|---|
| Aluminum Sulfate Powder (manufactured by Asada Chemical Industry Co., Ltd., 17% aluminum sulfate): | 35 parts by weight |
| Ion Exchange Water: | 1,965 parts by weight |

The above components are put into a 2 L container and mixed at 30° C. by stirring until precipitates disappear, thereby preparing an aluminum sulfate aqueous solution.

Violet Developer V1

Preparation of Violet Toner V1

| | |
|---|---|
| Amorphous Polyester Resin Particle Dispersion A1: | 700 parts |
| Crystalline Polyester Resin Particle Dispersion C1: | 50 parts |
| Violet Colorant Particle Dispersion V1: | 133 parts |
| Release Agent Particle Dispersion 1: | 100 parts |
| Ion Exchange Water: | 350 parts |
| Anionic Surfactant (manufactured by The Dow Chemical Company, DOWFAX 2A1): | 2.9 parts |

Anionic Surfactant (manufactured by the Dow Chemical Company, DOWFAX 2A1): 2.9 parts The above components are put into a 3 L reaction container provided with a thermometer, a pH meter, and a stirrer, and 1.0% nitric acid is added thereto at a temperature of 25° C. to adjust the pH to 3.0. Then, while the mixture is dispersed at 5,000 rpm by a homogenizer (manufactured by IKA-Werke GmbH & Co. KG., ULTRA TURRAX T50), 130 parts of the prepared aluminum sulfate aqueous solution is added and the mixture is dispersed for 6 minutes.

Thereafter, a stirrer and a mantle heater are installed on the reaction container, and the temperature is increased at a rate of temperature increase of 0.2° C./min until it reaches to 40° C. and at a rate of temperature increase of 0.05° C./min after it exceeds 40° C. while the rotation speed of the stirrer is adjusted so that the slurry is sufficiently stirred. The particle size is measured at intervals of 10 minutes by a MULTISIZER II (aperture size: 50 μm, manufactured by Beckman Coulter, Inc.). When the volume average particle size reaches 5.0 μm the temperature is kept, and 50 parts of the amorphous polyester resin dispersion A1 is put over 5 minutes.

After the mixture is kept for 30 minutes, the pH is adjusted to 9.0 using a 1% sodium hydroxide aqueous solution. Thereafter, the temperature is increased to 90° C. at a rate of temperature increase of 1° C./min while similarly adjusting the pH to 9.0 with each rise of 5° C., and the mixture is then kept at 90° C. As a result of observation of the particle shape and surface properties by an optical microscope and a scanning electron microscope (FE-SEM) at intervals of 15 minutes, coalescence of particles is confirmed after the elapse of 2.0 hours. Thus, the container is cooled with cooling water to 30° C. over 5 minutes.

The slurry after cooling is allowed to pass through a nylon mesh with an opening of 15 μm to remove a coarse powder, and a nitric acid is added to the toner slurry having passed through the mesh to adjust the pH to 6.0, followed by filtering under reduced pressure by an aspirator. The toner remaining on the filter paper is pulverized by hand finely as far as possible, and added to ion exchange water, the amount of which is 10 times the toner amount, at a temperature of 30° C. After mixing by stirring for 30 minutes, the mixture is filtered again under reduced pressure by the aspirator, and an electric conductivity of the filtrate is measured. This operation is repeated until the electric conductivity of the filtrate reaches 10 μS/cm or less, and the toner is washed.

The washed toner is finely pulverized by a dry/wet granulator (Comil) and then dried in a vacuum for 36 hours in an oven at 35° C., thereby obtaining toner particles. To 100 parts of the obtained toner particles, 1.0 part of hydrophobic silica (manufactured by Nippon Aerosil Co., Ltd., RY50) is added, followed by mixing and blending at 13,000 rpm for 30 seconds using a sample mill. Thereafter, the obtained material is sieved using a vibrating screen with an opening of 45 μm to obtain a violet toner V1.

Preparation of Resin-Coated Carrier

| | |
|---|---|
| Mn—Mg—Sr Ferrite Particles (average particle size: 40 μm): | 100 parts |
| Toluene: | 14 parts |
| Cyclohexyl Methacrylate/Dimethylaminoethyl Methacrylate Copolymer (copolymerization mass ratio: 99:1, weight average molecular weight Mw: 80,000): | 2.0 parts |
| Carbon Black (VXC72, manufactured by Cabot Corporation): | 0.12 part |

The above components, excluding the ferrite particles, and glass beads (ϕ1 mm, the same amount as toluene) are stirred for 30 minutes at 1,200 rpm using a sand mill manufactured by Kansai Paint Co., Ltd., thereby obtaining a resin coating layer forming solution. Furthermore, this resin coating layer forming solution and the ferrite particles are put into a vacuum deaeration-type kneader, the pressure is reduced, and the toluene is distilled away, followed by drying to prepare a resin-coated carrier.

Preparation of Violet Developer V1

40 parts of the violet toner V1 is added to 500 parts of the resin-coated carrier and blended for 20 minutes using a V-blender, and then aggregates are removed using a vibrating screen with an opening of 212 μm, thereby preparing a violet developer V1.

Violet Developers V2 to V10

Violet toners V2 to V10 are prepared in the same manner as in the case of the violet toner V1, except that the kind and the amount of each dispersion are changed according to Table 1 from those used in the preparation of the violet toner V1.

Using the respective toners, violet developers V2 to V10 are prepared in the same manner as in the case of the violet developer V1.

Violet Developer V11

20 parts of C.I. Pigment Violet 37 "CROMOPHTAL VIOLET D5700 (manufactured by BASF), 75 parts of ethyl acetate, 4 parts of DISPARLON DA-703-50 (an acid amide amine salt of polyester, manufactured by Kusumoto Chemicals, Ltd.) from which a solvent has been removed, and 1 part of SOLSPERSE 5000 (pigment derivative, manufactured by Zeneca, Ltd.) are dissolved and dispersed by a sand mill to prepare a pigment dispersion.

20 parts of hydrocarbon wax (manufactured by Nippon Seiro Co., Ltd., trade name: FNP0080, melting temperature: 80° C.) as a release agent and 80 parts of ethyl acetate, that have been cooled to 10° C., are wet-pulverized by a DCP mill to prepare a release agent dispersion. 160 parts of the amorphous polyester resin A1, 100 parts of the pigment dispersion, and 150 parts of ethyl acetate are stirred, and then 100 parts of the release agent dispersion is added thereto and stirred well until the mixture becomes uniform (this liquid is set as a liquid A).

Next, 130 parts of a calcium carbonate dispersion formed by dispersing 40 parts of calcium carbonate in 60 parts of water, 100 parts of a 2% aqueous solution of CELOGEN BS-H (manufactured by Dai-ichi Kogyo Seiyaku Co., Ltd.), and 100 parts of water are stirred for 5 minutes by using a homogenizer (ULTRA TURRAX, manufactured by IKA-Werke GmbH & Co. KG.) (this liquid is set as a liquid B).

While 600 parts of the liquid B is stirred at 10,000 rpm by using a homogenizer (ULTRA TURRAX, manufactured by IKA-Werke GmbH & Co. KG.), 510 parts of the liquid A is added thereto and stirred for 1 minute to suspend the mixed solution, and the solvent is removed by stirring using a propeller-type stirrer at room temperature under ordinary pressure. Next, a hydrochloric acid is added to remove calcium carbonate, and then washing with water and drying are performed. Subsequently, toner particles thus obtained are put into a spray dryer and instantaneously heated to be sphered by a surface tension, and then a fine powder is removed again by using an elbow jet classifier to obtain toner particles having an average particle size of 6.0 μm. Thereafter, a violet toner V11 is prepared in the same manner as in the case of the violet toner V1.

A violet developer V11 is prepared in the same manner as in the case of the violet developer V1.

Violet Developers V101 to V103

Violet toners V101 to V103 are prepared in the same manner as in the case of the violet toner V1, except that the kind and the amount of each dispersion are changed according to Table 1 from those used in the preparation of the violet toner V1.

Using the respective toners, violet developers V101 to V103 are prepared in the same manner as in the case of the violet developer V1.

Preparation of Magenta Developer M1 and Cyan Developer C1

A magenta toner M1 and a cyan toner C1 are prepared in the same manner as in the case of the violet toner V1, except that the kind and the amount of each dispersion are changed according to Table 1 from those used in the preparation of the violet toner V1.

Using the respective toners, a magenta developer M1 and a cyan developer C1 are prepared in the same manner as in the case of the violet developer V1.

Examples 1 to 11 and Comparative Examples 1 to 3

The prepared violet developers V1 to V11 are set as developers of Examples 1 to 11, respectively.

The prepared violet developers V101 to V103 are set as developers of Comparative Examples 1 to 3, respectively.

EVALUATION

In an environmental chamber at a temperature of 25° C. and a humidity of 60%, a main body, developing devices, and toner cartridges of DOCUCENTRE COLOR 400CP manufactured by Fuji Xerox Co., Ltd. are cleaned by thoroughly removing a developer and a toner having been previously set, and then the violet developer, the magenta developer, and the cyan developer according to Table 2 are put into the respective developing devices, and toners for replenishment are put into the respective toner cartridges.

The following evaluation is performed.

Color Gamut Evaluation (Single Color)

A developing toner amount of each single color (violet) (100%) image on OK top coated paper is adjusted to 4.0 g/m$^2$, and an image formed only of a violet toner and having a size of 5 cm×5 cm is prepared to measure an image density (L*) and a saturation ($c^*=(a^{*2}+b^{*2})^{0.5}$) thus obtained. The measurement is performed at random 10 positions in the image surface by using X-RITE 939 (aperture: 4 mm), and the measurement results are averaged. The density results and the saturation results are shown in Table 2.

The evaluation is performed according to the following standards.

Single Color Image Density

G5: less than 25

G4: from 25 to less than 27

G3: from 27 to less than 29

G2: from 29 to less than 31

G1: 31 or greater

The lower the value, the higher the image density (L*), and the acceptable range is from G3 to G5.

Single Color Saturation

G5: 68 or greater

G4: from 66 to less than 68

G3: from 64 to less than 66

G2: from 62 to less than 64

G1: less than 62

The higher the value, the higher the single color saturation (C*), and the acceptable range is from G3 to G5.

Color Gamut Evaluation (Secondary Color)

A developing toner amount of each single color (100%) image on OK top coated paper is adjusted to 4.0 g/m$^2$, and a magenta/violet secondary color image made of 100% of a magenta toner and 100% of a violet toner, and a cyan/violet secondary color image made of 100% of a cyan toner and 100% of a violet toner, each of which has a size of 5 cm×5 cm, are prepared to measure an image density (L*) and a saturation ($c^*=(a^{*2}+b^{*2})^{0.5}$) thus obtained. The measurement is performed at random 10 positions in the image surface by using X-RITE 939 (aperture: 4 mm), and the measurement results are averaged. The density results and the saturation results are shown in Table 2.

The evaluation is performed according to the following standards.

Magenta/Violet Secondary Color Image Density

G5: less than 41

G4: from 41 to less than 43

G3: from 43 to less than 45

G2: from 45 to less than 47

G1: 47 or greater

The lower the value, the higher the magenta/violet secondary color image density (L*), and the acceptable range is from G3 to G5.

Magenta/Violet Secondary Color Saturation

G5: 74 or greater

G4: from 72 to less than 74

G3: from 70 to less than 72

G2: from 68 to less than 70

G1: less than 68

The higher the value, the higher the magenta/violet secondary color saturation (c*), and the acceptable range is from G3 to G5.

Cyan/Violet Secondary Color Image Density

G5: less than 39

G4: from 39 to less than 41

G3: from 41 to less than 43

G2: from 43 to less than 45

G1: 45 or greater

The lower the value, the higher the cyan/violet secondary color image density (L*), and the acceptable range is from G3 to G5.

Cyan/Violet Secondary Color Saturation

G5: 66 or greater

G4: from 64 to less than 66

G3: from 62 to less than 64

G2: from 60 to less than 62

G1: less than 60

The higher the value, the higher the cyan/violet secondary color saturation (c*), and the acceptable range is from G3 to G5.

TABLE 1

| | Amorphous Polyester Resin Particle Dispersion | | | Crystalline Polyester resin Particle Dispersion | | Colorant Particle Dispersion | | Release Agent Particle Dispersion | | Molar Ratio of Trimellitic Anhydride in Amorphous Polyester (with respect | Proportion of Crystalline Polyester | Colorant Content |
|---|---|---|---|---|---|---|---|---|---|---|---|---|
| | No. | Number of Parts 1 | Number of Parts 2 | No. | Number of Parts | No. | Number of Parts | No. | Number of Parts | to entire polymerization components) | (with respect to entire binder resin) | (with respect to toner particles) |
| Violet Developer (toner) V1 | A1 | 700 | 50 | C1 | 50 | V1 | 133 | 1 | 100 | 1.05 mol % | 6.3% by weight | 10% by weight |
| Violet Developer (toner) V2 | A2 | 700 | 50 | C1 | 50 | V1 | 133 | 1 | 100 | 0.1 mol % | 6.3% by weight | 10% by weight |
| Violet Developer (toner) V3 | A3 | 700 | 50 | C1 | 50 | V1 | 133 | 1 | 100 | 9.7 mol % | 6.3% by weight | 10% by weight |
| Violet Developer (toner) V4 | A1 | 700 | 50 | C1 | 50 | V1 | 133 | 2 | 100 | 1.05 mol % | 6.3% by weight | 10% by weight |
| Violet Developer (toner) V5 | A1 | 700 | 50 | C1 | 50 | V1 | 133 | 3 | 100 | 1.05 mol % | 6.3% by weight | 10% by weight |
| Violet Developer (toner) V6 | A1 | 700 | 50 | C1 | 50 | V1 | 133 | 4 | 100 | 1.05 mol % | 6.3% by weight | 10% by weight |
| Violet Developer (toner) V7 | A1 | 700 | 50 | C1 | 50 | V1 | 133 | 5 | 100 | 1.05 mol % | 6.3% by weight | 10% by weight |
| Violet Developer (toner) V8 | A1 | 750 | 50 | C1 | 0 | V1 | 133 | 1 | 100 | 1.05 mol % | 0% by weight | 10% by weight |
| Violet Developer (toner) V9 | A1 | 742 | 50 | C1 | 8 | V1 | 133 | 1 | 100 | 1.05 mol % | 1.0% by weight | 10% by weight |
| Violet Developer (toner) V10 | A1 | 670 | 50 | C1 | 80 | V1 | 133 | 1 | 100 | 1.05 mol % | 10.0% by weight | 10% by weight |
| Violet Developer (toner) V11 | Toner particles are prepared by a dissolution and suspension method. | | | | | | | | | 1.05 mol % | 0% by weight | 10% by weight |
| Violet Developer (toner) V101 | B1 | 700 | 50 | C1 | 50 | V1 | 133 | 1 | 100 | 0.0 mol % | 6.3% by weight | 10% by weight |
| Violet Developer (toner) V102 | B2 | 700 | 50 | C1 | 50 | V1 | 133 | 1 | 100 | 0.08 mol % | 6.3% by weight | 10% by weight |
| Violet Developer (toner) V103 | B3 | 700 | 50 | C1 | 50 | V1 | 133 | 1 | 100 | 10.2 mol % | 6.3% by weight | 10% by weight |
| Magenta Developer (toner) M1 | M1 | 700 | 50 | C1 | 50 | M1 | 133 | 1 | 100 | 1.05 mol % | 6.3% by weight | 10% by weight |
| Cyan Developer (toner) C1 | C1 | 700 | 50 | C1 | 50 | C1 | 133 | 1 | 100 | 1.05 mol % | 6.3% by weight | 10% by weight |

"Number of Parts 1" of the amorphous polyester resin particle dispersion: The number of parts for preparation of aggregated particles "Number of Parts 2" of the amorphous polyester resin particle dispersion: The number of parts for addition after preparation of aggregated particles

TABLE 2

| | Developer | | | Single Color (violet) | | Magenta/Violet Secondary Color | | Cyan/Violet Secondary Color | |
|---|---|---|---|---|---|---|---|---|---|
| | Violet | Magenta | Cyan | Image Density | Single Color Saturation | Image Density | Secondary Color Saturation | Image Density | Secondary Color Saturation |
| Example 1 | V1 | M1 | C1 | G5 | G5 | G5 | G5 | G5 | G5 |
| Example 2 | V2 | M1 | C1 | G4 | G4 | G4 | G4 | G4 | G4 |
| Example 3 | V3 | M1 | C1 | G4 | G4 | G4 | G4 | G4 | G4 |
| Example 4 | V4 | M1 | C1 | G4 | G4 | G4 | G4 | G4 | G4 |
| Example 5 | V5 | M1 | C1 | G5 | G5 | G5 | G5 | G5 | G5 |
| Example 6 | V6 | M1 | C1 | G3 | G3 | G3 | G3 | G3 | G3 |
| Example 7 | V7 | M1 | C1 | G3 | G3 | G3 | G3 | G3 | G3 |
| Example 8 | V8 | M1 | C1 | G3 | G3 | G3 | G3 | G3 | G3 |
| Example 9 | V9 | M1 | C1 | G4 | G4 | G4 | G4 | G4 | G4 |
| Example 10 | V10 | M1 | C1 | G4 | G4 | G4 | G4 | G4 | G4 |
| Example 11 | V11 | M1 | C1 | G3 | G3 | G3 | G3 | G3 | G3 |
| Comparative Example 1 | V101 | M1 | C1 | G1 | G1 | G1 | G1 | G1 | G1 |
| Comparative Example 2 | V102 | M1 | C1 | G2 | G2 | G2 | G2 | G2 | G2 |
| Comparative Example 3 | V103 | M1 | C1 | G2 | G2 | G2 | G2 | G2 | G2 |

From the above results, it is found that, as compared with the violet developers of the comparative examples, the violet developers of the examples are excellent in the single image density and the single color saturation, and in the secondary color image density and the secondary color saturation using the magenta developer and the cyan developer, and thus an image having wide color reproducibility is obtained.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner set comprising:

a violet toner comprising:

toner particles that contain a binder resin including an amorphous polyester resin composed of a polycondensate of a polyol and a polyvalent carboxylic acid including a trimellitic acid, and C.I. Pigment Violet 37, wherein a molar ratio of the trimellitic acid is from 0.1 mol % to 10 mol % with respect to the entire polymerization components of the amorphous polyester resin, and a content of C.I. Pigment Violet 37 is from 1% by weight to 20% by weight with respect to the total weight of the toner particles;

a magenta toner; and a cyan toner.

2. The toner set according to claim 1, wherein a glass transition temperature (Tg) of the amorphous polyester resin is from 50° C. to 80° C.

3. The toner set according to claim 1, wherein a weight average molecular weight (Mw) of the amorphous polyester resin is from 5,000 to 1,000,000.

4. The toner set according to claim 1, wherein a molecular weight distribution Mw/Mn of the amorphous polyester resin is from 1.5 to 100.

5. The toner set according to claim 1, the violet toner further comprising a crystalline polyester resin.

6. The toner set according to claim 5, wherein a melting temperature of the crystalline polyester resin is from 50° C. to 100° C.

7. The toner set according to claim 5, wherein a weight average molecular weight (Mw) of the crystalline polyester resin is from 6,000 to 35,000.

8. The toner set according to claim 1, the violet toner further comprising a release agent having a melting temperature of from 60° C. to 100° C., wherein the binder resin includes a crystalline polyester resin in an amount of from 1% by weight to 10% by weight with respect to the entire binder resin, and the release agent has a melting temperature that is higher than the melting temperature of the crystalline polyester resin.

9. The toner set according to claim 8, wherein the release agent is a hydrocarbon wax.

10. The toner set according to claim 1, wherein a volume average particle size (D50v) of the toner particles is from 2 μm to 10 μm.

11. The toner set according to claim 1, wherein a shape factor SF1 of the toner particles is from 110 to 150.

12. A developer comprising:

the toner set according to claim 1.

13. The toner set according to claim 1, the toner set further comprising a yellow toner.

14. The toner set according to claim 1, wherein the magenta toner includes at least one selected from the group consisting of C.I. Pigment Red 238 and C.I. Pigment Red 269.

15. The toner set according to claim 1, wherein the cyan toner includes C.I. Pigment Blue 15.

* * * * *